United States Patent [19]

Reinehr et al.

[11] 4,239,722

[45] Dec. 16, 1980

[54] PROCESS FOR THE PRODUCTION OF HYDROPHILIC FIBRES

[75] Inventors: Ulrich Reinehr, Dormagen; Herman-Josef Jungverdorben, Grevenbroich; Toni Herbertz, Dormagen; Joachim Dross, Dormagen; Rolf-Burkhard Hirsch, Dormagen, all of Fed. Rep. of Germany

[73] Assignee: Bayer Aktiengesellschaft, Leverkusen, Fed. Rep. of Germany

[21] Appl. No.: 859,216

[22] Filed: Dec. 9, 1977

[30] Foreign Application Priority Data

Dec. 16, 1976 [DE] Fed. Rep. of Germany ..... 2657144

[51] Int. Cl.[3] ..... D02G 3/00

[52] U.S. Cl. ..... 264/206; 264/211; 264/233

[58] Field of Search ..... 264/182, 206, 211, 233; 260/30.8, 33.4 R, 29.6 AB

[56] References Cited

U.S. PATENT DOCUMENTS

| | | | |
|---|---|---|---|
| 2,075,888 | 4/1937 | Dreyfus | 264/211 |
| 2,293,760 | 8/1942 | Peters | 260/33.4 R |
| 2,585,672 | 2/1952 | Mosse | 260/33.4 R |
| 2,684,281 | 7/1954 | Lincoln | 260/33.4 R |
| 2,716,093 | 8/1955 | McClellan | 260/29.6 AB |
| 2,948,581 | 8/1960 | Cummings | 264/182 |
| 3,180,845 | 4/1965 | Knudsen et al. | 264/211 |
| 3,410,819 | 11/1968 | Kourtz et al. | 264/182 |
| 3,450,650 | 6/1969 | Murata | 260/33.4 R |
| 3,879,506 | 4/1975 | Melacini et al. | 264/205 |
| 3,896,204 | 7/1975 | Goodman et al. | 264/210 F |
| 3,948,840 | 4/1976 | Szita et al. | 264/182 |
| 3,984,601 | 10/1976 | Blickenstaff | 264/211 |
| 3,991,153 | 11/1976 | Klausner et al. | 264/182 |
| 4,163,078 | 7/1979 | Reinehr et al. | 264/210.8 F |

FOREIGN PATENT DOCUMENTS

| | | | |
|---|---|---|---|
| 41-2733 | 2/1966 | Japan | 264/211 |
| 45-40700 | 12/1970 | Japan | 264/206 |
| 46-5207 | 2/1971 | Japan | 264/182 |
| 51-66363 | 6/1976 | Japan | 264/206 |

*Primary Examiner*—Jay H. Woo

*Attorney, Agent, or Firm*—Sprung, Felfe, Horn, Lynch & Kramer

[57] ABSTRACT

The invention relates to a process for the production of hydrophilic filaments and fibers from filament-forming synthetic polymers by spinning a solution which, in addition to a suitable solvent, contains from 5 to 50% by weight, based on the solvent and solids, of a substance which is essentially a non-solvent for the polymer, has a higher boiling point than the solvent used and is readily miscible with the spinning solvent and with a liquid suitable as a washing liquid for the filaments, and subsequently washing this substance out of the filaments, wherein a suspension is initially prepared at room temperature from the solvent, the polymer and the substance, the suspension thus prepared is subsequently heated, left for at least one minute and at most 15 minutes at a temperature of at least 30° C. and of at most 60° C. above the temperature at which the suspension becomes optically homogeneous, spinning the solution to form filaments or fibers and washing the said substance out of the filaments or fibers.

11 Claims, 1 Drawing Figure

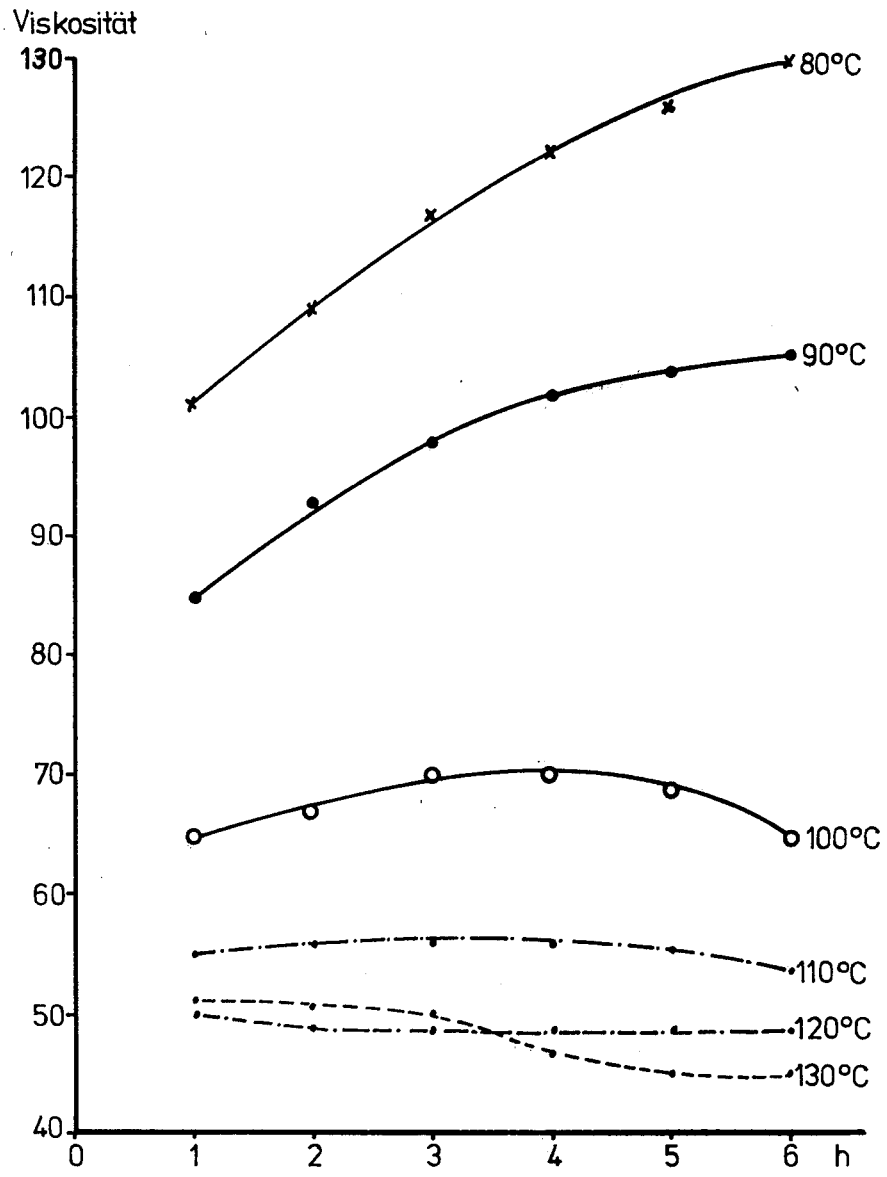
Viskosität
130
120
110
100
90
80
70
60
50
40
0
1
2
3
4
5
6
h
80°C
90°C
100°C
110°C
120°C
130°C

PROCESS FOR THE PRODUCTION OF HYDROPHILIC FIBRES

It has already been proposed to produce hydrophilic filaments and fibres from filament-forming synthetic polymers by adding to the spinning solvent from 5 to 50% by weight, based on the solvent and solids, of a substance which is essentially a non-solvent for the polymer, has a higher boiling point than the solvent used and is readily miscible with the spinning solvent and with a liquid suitable as a washing liquid for the filaments, and subsequently washing this non-solvent out of the filaments produced.

Fibres such as these spun from acrylonitrile polymers, for example, have a core-jacket structure and a water retention capacity of at least 10%. The higher the percentage by weight of non-solvent added, the more hydrophilic are the filaments.

Where this procedure is adopted, however, difficulties are encountered in regard to the viscosity stability of the solution, particularly in cases where solutions having relatively high solids contents are spun.

However, high solids concentrations are desirable insofar as they enable very high throughputs to be obtained and large quantities of spinning solvent to be saved.

Normally, polyacrylonitrile solutions having K-values of approximately 80 can only be spun in the form of at most 28 33% by weight solutions because, with higher concentrations, the viscosities rise very considerably and gelation occurs.

However, if 2.5 kg of polyacrylonitrile powder are added, for example to a mixture of 6 kg of dimethyl formamide and 1.5 kg of glycerol, a clear spinnable solution is obtained at a solution temperature of 100° C. Unfortunately, this solution quickly clouds at lower temperatures and gels at around 80° C.

A spinning solution of, for example, 25% by weight of polyacrylonitrile solids, 10% by weight of glycerol and 65% by weight of dimethyl formamide is still not stable in viscosity at solution temperatures below 100° C., even after standing for several hours.

Accordingly, filament breaks and agglomerations occur during the spinning of solutions such as these.

It has now surprisingly been found that mixtures of the type in question can be spun satisfactorily providing the substances are initially combined in the form of a suspension at low temperatures, subsequently heated, left for a certain time at certain temperatures and subsequently spun.

Accordingly, the present invention provides a process for the production of hydrophilic filaments and fibers from filament-forming synthetic polymers by spinning a solution which, in addition to a suitable solvent, contains from 5 to 50% by weight, based on the solvent and solids, of a substance which is essentially a non-solvent for the polymer, has a higher boiling point than the solvent used and is readily miscible with the spinning solvent and with a liquid suitable as a washing liquid for the filaments, and subsequently washing this substance out of the filaments, wherein a suspension is initially prepared at room temperature from the solvent, the polymer and the substance, the suspension thus formed is subsequently heated and left for at least one minute and for at most 15 minutes at a temperature which is at least 30° C. and at most 60° C. above the temperature at which the suspension becomes optically homogeneous, and is then delivered to the spinning stage.

Acrylonitrile polymers containing at least 50% by weight of acrylonitrile units are preferably spun by the process according to the invention. The spinning process is preferably a dry spinning process.

Suitable non-solvents are solid and liquid substances. Examples of suitable non-solvents are the mono-substituted and polysubstituted alkyl ethers and esters of polyhydric alcohols, such as glycerol, diethylene glycol, triethylene glycol, triethylene glycol diacetate, tetraethylene glycol, glycol ether acetates, and also high-boiling alcohols such as, for example, 2-ethyl cyclohexanol, esters and ketones or even mixtures thereof. Suitable solids are, for example, monohydric or polyhydric alcohols, esters or ketones such as, for example, 1,6-hexane diol, p-hydroxy benzoic acid methyl ester, inorganic or organic acids and salts such as, for example, isophthalic acid, pyromellitic acid, zinc chloride and magnesium chloride, or even sugars such as, for example, DL-sorbose. However, one important requirement is always that the substances added should be readily soluble in water or, optionally, in another washing liquid so that they can be subsequently removed from the fibres during the aftertreatment. Glycerol and tetraethylene glycol are particularly preferred.

As already mentioned, the temperature to which the suspension is heated is at least 30° C. and at most 60° C. above the temperature at which the solution becomes optically homogeneous, i.e. clear. However, this temperature naturally varies in dependence upon the solids content, upon the composition of the polymer, upon the type and quantity of non-solvent added and upon the type and quantity of solvent used. In general, however, the temperature is above 100° C. and preferably in the range of from 120° to 150° C.

The spinning solution is left at that temperature for at least one minute. If the solution is heated at that temperature for less than one minute, variations in denier occur at the spinneret because a state of complete viscosity stability has not yet been reached.

Satisfactory spinning solutions are produced with residence times of from 1 to 15 minutes and preferably from 3 to 5 minutes. However, the residence times should not be more than 15 minutes, particularly at temperatures near the upper limit of the abovementioned range, because otherwise the natural colour of the solution deteriorates. In other words, fibres with a yellowish colour are obtained.

The spinning solution is preferably filtered on completion of the temperature treatment and is preferably delivered directly to the spinneret at the same temperature. There is, of course, no need for spinning to be carried out at exactly the same temperature as the temperature treatment, although it is important to ensure that, after they have been brought to the high temperatures, the spinning solutions are not allowed to cool to temperatures below 80° C. because otherwise they would be in danger of clouding and gelling.

By applying the process according to the invention, it is possible to spin, for example, a 40% solution of polyacrylonitrile in dimethyl formamide which contains 8% by weight of glycerol into hydrophilic core-jacket fibres as satisfactorily as, for example, a mixture of 24% by weight of polyacrylonitrile, 24% by weight of glycerol and 52% by weight of dimethyl formamide.

The accompanying drawing shows the dependence of the viscosity of a solution of 25% by weight of polyacrylonitrile, 10% by weight of glycerol and 65% by weight of dimethyl formamide upon the solution temperature and the standing time. The viscosity is expressed in ball drop seconds (measured in accordance with K. Jost, Reologika Acta, Vol. 1, Nos. 2 to 3 (1958), page 303).

In the following Examples, the parts and percentages quoted are by weight, unless otherwise stated.

EXAMPLE I 15.6 kg of dimethyl formamide (DMF) are mixed while stirring with 7.2 kg of glycerol in a vessel. 7.2 kg of an acrylonitrile polymer of 93.6% of acrylonitrile, 5.7% of acrylic acid methyl ester and 0.7% of sodium methallyl sulphonate are then added with stirring at room temperature. The suspension is pumped by a gear pump into a spinning vessel provided with a stirrer. The suspension, which has a solids concentration of 24% and a glycerol content of 24% by weight, based on DMF and polyacrylonitrile powder, is then heated with steam under a pressure of 3.2 bars in a 60 cm long double-walled tube with an internal diameter of 8 cm. The temperature of the solution at the outlet end of the tube is 135° C. The tube contains several mixing combs for homogenising the spinning solution. After leaving the heating stage, the spinning solution is filtered and delivered to the spinning duct. The total residence time of the suspension from the heating stage to the spinneret amounts to 10 minutes.

The spinning solution is dry-spun from a 180 bore spinneret by methods known in the art. The spun filaments with a denier of 1720 dtex are collected on bobbins and doubled to form a tow with an overall denier of 103,200 dtex. The tow is then drawn in boiling water and aftertreated in the usual way to form fibres with a final denier of 3.3 dtex. The core-jacket fibres have a water retention capacity of 117%, a tensile strength of 2.9 p/dtex and an elongation at break of 31%.

The compositions of other spinning solutions are shown in the following Table. They were all spun in the same way as described in Example 1 to form core-jacket fibres with a final denier of 3.3. dtex. The polymer of Example 1 was used as the solids component. None of the systems could be spun by conventional solution processes on account of gelling.

TABLE 1

| Polymer solids content (%) | Glycerol (%) | DMF (%) | Water retention capacity of the filaments (according to DIN 53 814 in %) |
|---|---|---|---|
| 19 | 17 | 66 | 105 |
| 19 | 19 | 62 | 153 |
| 22 | 22 | 52 | 145 |
| 27 | 21 | 52 | 110 |
| 31 | 17 | 52 | 73 |
| 36 | 12 | 52 | 75 |
| 40 | 8 | 52 | 28 |

EXAMPLE 2

60 kg of DMF are mixed while stirring with 17.5 kg of tetraethylene glycol in a vessel. 22.5 kg of an acrylonitrile copolymer with the same composition as in Example 1 are then added with stirring at room temperature. The suspension, which has a solids concentration of 22.5% and a tetraethylene glycol content of 17.5%, based on DMF and polyacrylonitrile powder, is dissolved, filtered and spun in the same way as described in Example 1. The spun filaments are aftertreated to form hydrophilic core-jacket fibres with a final denier of 3.3 dtex. The water retention capacity amounts to 98%. Tensile strength 2.8 p/dtex, elongation at break 37%.

EXAMPLE 3

60 kg of DMF are mixed while stirring in a vessel with 17.5 kg of p-hydroxy benzoic acid methyl ester. 22.5 kg of an acrylonitrile polymer having the same composition as in Example 1 are then added with stirring at room temperature. The suspension, which has a polymer solids concentration of 22.5% and a solid p-hydroxy benzoic acid content of 17.5%, is prepared, spun and aftertreated to form core-jacket fibres with a final denier of 3.3 dtex in the same way as described in Example 1. The water retention capacity amounts to 84%. Tensile strength 2.6 p/dtex, elongation at break 39%.

EXAMPLE 5 (Comparison)

(a) 60.0 kg of DMF are mixed while stirring in a vessel with 17.5 kg of glycerol. 22.5 kg of an acrylonitrile polymer having the same chemical composition as in Example 1 are then added with stirring at room temperature. The suspension is dissolved and filtered in the same way as described in Example 1. The residence time of the suspension in the heating section at 135° C. only amounts to about 40 seconds.

The suspension is then dry-spun from a 180-bore spinneret. The individual capillaries show considerable fluctuations in denier. Variations in the spinning conditions, for example different take-off rates, air and duct temperatures, do not produce any improvement.

(b) Part of the spinning solution is stored for 20 minutes at 135° C. and then spun and aftertreated in the same way as described in Example 1. The fibres have a cream to yellowish natural colour.

What we claim is:

1. In the process of producing hydrophilic filaments or fibers by dry spinning a solution comprising a solvent consisting essentially of dimethyl formamide, 19 to 40 by weight of a filament forming synthetic polymer containing at least 50 percent acrylonitrile units and from 5 to 50 percent by weight based on the solvent and polymer, of a substance which is essentially a non-solvent for the polymer and has a higher boiling point than the solvent used and is readily miscible with the solvent and with a liquid suitable as a washing liquid for the filaments or fibers to form filaments or fibers, and washing the said substance out of the filaments or fibers; the improvement comprising preparing a suspension of said constituents of the spinning solution, heating the suspension and leaving it for a period of from 1 to 15 minutes at a temperature of from 30° C. to 60° C. above the temperature at which the suspension becomes optically homogeneous and thereafter dry-spinning the solution and washing said substance out of the filaments or fibers.

2. The process of claim 1, wherein said solution is spun without intermediate cooling.

3. The process of claim 1, wherein said substance added is glycerol or tetraethylene glycol.

4. The process of claim 1, wherein said polymer is an acrylonitrile polymer containing at least 50% by weight of acrylonitrile units.

5. A process according to claim 5 wherein said spinning solution consists essentially of said dimethyl formamide, said substance and said polymer.

6. A process according to claim 5 wherein said substance is a solid.

7. A process according to claim 6 wherein said solid is a monohydric, a polyhydric alcohol, an ester, a ketone, an inorganic acid, an organic acid, an inorganic salt, an organic salt or a sugar.

8. A process according claim 7 wherein said solid is 1,6-hexane diol, p-hydroxy benzoic acid methyl ester, isophthalic acid, pyromellitic acid, zinc chloride, magnesium chloride or DL-sorbose.

9. A process according to claim 5 wherein said substance is a liquid.

10. A process according to claim 9 wherein said liquid is a mono-substituted or poly-substituted alkyl ether or ester of a polyhydric alcohol an ester or a ketone or high boiling alcohol.

11. A process according to claim 10 wherein said liquid substance is glycerol, diethylene glycol, triethylene glycol, triethylene glycol diacetate, tetraethylene glycol, glycol ether acetate.

* * * * *

UNITED STATES PATENT AND TRADEMARK OFFICE

CERTIFICATE OF CORRECTION

PATENT NO. : 4,239,722

DATED : December 16, 1980

INVENTOR(S) : Ulrich Reinehr, Hermann-Josef Jungverdorben, Toni Herbertz, Joachim Dross, Rolf-Burkhard Hirsch It is certified that error appears in the above-identified patent and that said Letters Patent are hereby corrected as shown below:

| Column | Line | |
|---|---|---|
| 1 | 30 | insert "to" after "28" |

Signed and Sealed this

*Seventeenth* Day of *March 1981*

[SEAL]

*Attest:*

RENE D. TEGTMEYER

*Attesting Officer*

*Acting Commissioner of Patents and Trademarks*